US005679218A

United States Patent [19]

Vinson et al.

[11] Patent Number: 5,679,218

[45] Date of Patent: Oct. 21, 1997

[54] TISSUE PAPER CONTAINING CHEMICALLY SOFTENED COARSE CELLULOSE FIBERS

[75] Inventors: Kenneth Douglas Vinson, Cincinnati; Howard Thomas Deason, Hamilton, both of Ohio

[73] Assignee: The Procter & Gamble Company, Cincinnati, Ohio

[21] Appl. No.: 614,870

[22] Filed: Mar. 13, 1996

Related U.S. Application Data

[63] Continuation-in-part of Ser. No. 282,331, Jul. 29, 1994, abandoned.

[51] Int. Cl.[6] ..... D21H 11/00

[52] U.S. Cl. ..... 162/109; 162/111; 162/112; 162/113; 162/127; 162/129; 162/130; 162/147; 162/149; 162/158; 162/164.4; 162/179; 162/182

[58] Field of Search ..... 162/9, 111, 112, 162/113, 158, 129, 130, 127, 147, 149, 164.4, 179, 100, 109, 182

[56] References Cited

U.S. PATENT DOCUMENTS

| | | | |
|---|---|---|---|
| 1,951,017 | 3/1934 | Hatch | 92/20 |
| 2,947,655 | 8/1960 | Eberhardt | 162/26 |
| 3,016,324 | 1/1962 | Textor | 162/24 |
| 3,041,246 | 6/1962 | Bolaski et al. | 195/8 |
| 3,085,927 | 4/1963 | Pesch | 162/55 |
| 3,301,745 | 1/1967 | Coppick et al. | 162/55 |
| 3,352,745 | 11/1967 | Malm | 162/55 |
| 3,406,089 | 10/1968 | Yerkes, Jr. | 162/199 |
| 3,441,130 | 4/1969 | Sisson et al. | 209/2 |
| 3,791,917 | 2/1974 | Bolton, III | 162/55 |
| 3,994,771 | 11/1976 | Morgan, Jr. et al. | 162/113 |
| 4,292,122 | 9/1981 | Karnis et al. | 162/28 |
| 4,334,984 | 6/1982 | Vagac et al. | 209/3 |
| 4,435,249 | 3/1984 | Markham et al. | 162/24 |
| 4,504,016 | 3/1985 | Wikdahl | 241/24 |
| 4,562,969 | 1/1986 | Lindahl | 241/21 |
| 4,599,138 | 7/1986 | Lindahl | 162/19 |
| 4,731,160 | 3/1988 | Prough et al. | 162/55 |
| 4,776,926 | 10/1988 | Lindahl | 162/28 |
| 4,874,465 | 10/1989 | Cochrane et al. | 162/111 |
| 4,888,092 | 12/1989 | Prusas et al. | 162/130 |
| 4,915,821 | 4/1990 | Lamort | 209/17 |
| 4,923,565 | 5/1990 | Fuentes et al. | 162/72 |
| 4,938,843 | 7/1990 | Lindhal | 162/55 |
| 4,985,119 | 1/1991 | Vinson et al. | 162/149 |
| 5,112,444 | 5/1992 | Henricson et al. | 162/55 |
| 5,145,010 | 9/1992 | Danielsson et al. | 162/26 |
| 5,147,504 | 9/1992 | Henricson et al. | 162/55 |
| 5,178,729 | 1/1993 | Janda | 162/101 |
| 5,228,954 | 7/1993 | Vinson et al. | 162/100 |
| 5,277,761 | 1/1994 | Phan et al. | 162/109 |
| 5,320,710 | 6/1994 | Reeves et al. | 162/111 |
| 5,405,499 | 4/1995 | Vinson | 162/100 |

FOREIGN PATENT DOCUMENTS 0 568 404 A1 3/1993 European Pat. Off. .

*Primary Examiner*—Peter Chin

*Attorney, Agent, or Firm*—Bart S. Hersko; E. Kelly Linman; Jacobus C. Rasser

[57] ABSTRACT

Tissue paper webs useful in the manufacture of soft, absorbent sanitary products such as bath tissue, facial tissue, and napkins are provided. The composite average coarseness of the tissue papers is between about 11 mg/100 m and about 18 mg/100 m. The tissue paper comprise closed cell wall, chemically softened cellulose fibers further comprising coarse cellulose fibers such as those derived from CTMP or recycled sources. The cellulose fibers have enhanced lubricity such that they possess a depressed coefficient of friction (DCOF, in percentage points) related to the composite average coarseness, C, in mg/100 m, by the equation:

$$DCOF > 4.27 * C - 44.23.$$

19 Claims, 1 Drawing Sheet

TISSUE PAPER CONTAINING CHEMICALLY SOFTENED COARSE CELLULOSE FIBERS

This application is a continuation-in-part of application Ser. No. 08/282,331, filed on Jul. 29, 1994 now abandoned.

TECHNICAL FIELD

This invention relates, in general, to tissue paper; and more specifically to sanitary tissue paper made from low grade cellulose pulps characterized as low grade because of their relatively high coarseness.

BACKGROUND OF THE INVENTION

As the world's supply of native fiber comes under increasing economic and environmental scrutiny, pressure is mounting to utilize lower grade cellulose fibers such as those produced from recycled paper and those produced from higher yield mechanical or chemi-mechanical processes. Unfortunately, such fibers, when added to sanitary tissues, cause comparatively severe deterioration of the product characteristic most sought after by consumers of sanitary tissues, namely the aesthetic qualities and most specifically the softness.

The culpable fiber characteristic is mainly the coarseness. The aforementioned lower grade cellulose fibers typically possess a high coarseness. This contributes to the loss of the velvety feel which is imparted by prime fibers selected because of their flaccidness. U.S. Pat. No. 4,300,981, Carstens, issued Nov. 17, 1981, and incorporated herein by reference, explains the textural and surface qualities which are imparted by these prime fibers.

A secondary culpable characteristic which coarse fibers often possess is an undesirable non-uniformity in fiber coarseness. For example, it is believed that one of the advantages of the bleached kraft pulp made from eucalyptus as regards making soft tissue is that it tends to be highly uniform in coarseness in addition to having a desirable average coarseness. One index of the distribution of coarseness within a specimen of pulp fibers can be obtained by measuring and ranking the specimen fibers by fiber surface area to obtain a group of fibers within the pulp specimen comprising the largest one percent of fibers in the specimen. The surface area of the smallest surface area fiber in this group, referred to as the minimum fiber surface area, provides an index of the coarseness distribution in the pulp specimen. A comparatively low value of this minimum fiber surface area indicates that the pulp specimen is relatively uniform with respect to coarseness. A comparatively high value of the minimum fiber surface area indicates that the pulp specimen is relatively non-uniform and will be less desirable for the application at hand even if the average coarseness of the specimen is in a desirable range.

In addition, it is necessary to consider the relative content of hardwood and softwood in judging whether a particular pulp specimen has a comparatively low or high value of minimum fiber surface area. A technique for determining whether a particular sample has a comparatively high or low value of minimum fiber surface area is discussed in the specification. The measured minimum fiber surface area can be reduced by a scale factor for each percentage of softwood in the pulp specimen. This reduced minimum fiber surface area is referred to as the fiber incremental surface area. A pulp specimen having a value of fiber incremental surface area below a threshold level is considered to be uniform with respect to coarseness.

Desirable surface qualities are absent when the lower grade fibers such as described above are used.

High coarseness, in particular, is due to the retention of the non-cellulosic components of the original wood substance in the case of the mechanical or chemi-mechanical liberated fiber. The non-cellulosic components comprise lignin and so-called hemicelluloses. This makes each fiber weigh more without increasing its length.

Recycled paper can also tend to have a high mechanical pulp content, but, even when all due care is exercised in selecting the wastepaper grade to minimize this, a high coarseness still often occurs. This is thought to be due to the impure mixture of fiber morphologies which naturally occurs when paper from many sources is blended to make a recycled pulp. For example, a certain wastepaper might be selected because it is primarily North American hardwood in nature; however, one will often find extensive contamination from coarser softwood fibers, even of the most deleterious species such as variations of Southern U.S. pine.

Over the history of papermaking, many inventors have directed their energies toward designing methods to overcome the limitations of lower quality fibers to make them acceptable for the uses described herein.

One method is to reduce the coarseness of fibers by lengthwise slicing of the individual fibers with a sliding microtome. Slicing fibers lengthwise reduces the fiber weight per unit fiber length, i.e. the coarseness, but is distinctive in that it alters the naturally occurring closed fiber cell wall cross-section to an open fiber cell wall cross-section. Such a method is disclosed in U.S. Pat. No. 4,874,465 issued Oct. 17, 1989 to Cochrane et al. Slicing fibers lengthwise requires meticulous processing and is not considered to be a commercially feasible method of providing the quantities of fibers needed for making tissue products and those skilled in the art will recognize that forming an open cell wall structure is degradative to the intrinsic tenacity of the fibers, a side effect which causes the fibers to yield weaker paper structures. Accordingly, one of the principal advantages of the present invention is that it provides for a soft tissue paper which is essentially free of fibers of the open fiber cell wall type.

Another method of increasing softness of coarse fiber structures has been to add various types of softening chemicals. However, of the many chemical additives which have been proposed for use in softening tissues, no system has, up to now, proven potent enough to make truly soft tissue from furnishes described previously as being coarse, unless excessive amounts or unnecessary additives resulting in comparatively expensive products which accordingly might by relegated to specialty niches unavailable to the vast majority of the population.

Therefore, it is one object of the present invention to provide for a low density fibrous tissue structure which has a tactically pleasing response.

It is another object of the invention to incorporate a critical amount of fibers normally regarded as being coarse and inferior with regard to the above object.

It is another object of the present invention to provide the tissue essentially free of fibers with open cell walls.

It is another object of the present invention to avoid the excessive use of chemical treatments which add to the expense of making and distributing the product.

These and other objects are obtained using the present invention as will be taught in the following disclosure.

SUMMARY OF THE INVENTION

It has been found that an unexpected softness can be achieved in tissue structures comprised of closed cell wall cellulose fibers consisting partially of coarse cellulose fibers, provided the coarse fibers are present in sufficient amount to raise the composite average coarseness of the tissue paper to greater than about 11, but less than about 18 mg/100 m.

Unexpected softness results when the cellulose fibers are chemically softened such that they possess a depressed coefficient of friction (DCOF), in percentage points, related to the composite average coarseness (C), in mg/100 m, by the equation:

$$DCOF > 4.27 * C - 44.23;$$

This relationship makes it possible to provide for a soft tissue without the need to load unnecessary additives to mask the harshness of coarse fibers or to resort to lengthwise slicing of fibers, which is meticulous and creates the undesirable open cell wall fiber microstructure.

In its preferred embodiment the present invention utilizes coarse fibers selected such that they possess an incremental surface area less than about 0.085 square millimeters.

The soft tissue paper has a specific tensile strength between about 9 and about 25 g/in/g/m$^2$ and a density between about 0.05 and about 0.20 g/cc.

In its preferred embodiment the invention provides for a targeted treatment, capable of essentially coating the fibers, in relation to their specific surface, with a substantive chemical softener, preferably in amounts ranging from about 0.05% to about 2.0%, by weight. Preferred chemical softeners include quaternary ammonium compounds having the formula:

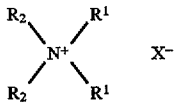

In the structure named above each $R_1$ is a C14–C22 hydrocarbyl group, preferably tallow, $R_2$ is a C1–C6 alkyl or hydroxyalkyl group, preferably C1–C3 alkyl, $X^-$ is a compatible anion, such as an halide (e.g. chloride or bromide) or methyl sulfate. As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention.

Preferably, each $R_1$ is C16–C18 alkyl, most preferably each $R_1$ is straight-chain C18 alkyl. Preferably, each $R_2$ is methyl and $X^-$ is chloride or methyl sulfate.

Examples of quaternary ammonium compounds suitable for use in the present invention include the well-known dialkyldimethylammonium salts such as ditallowdimethylammonium chloride, ditallowdimethylammonium methyl sulfate, di(hydrogenated) tallow dimethyl ammonium chloride; with di(hydrogenated) tallow dimethyl ammonium methyl sulfate being preferred. This particular material is available commercially from Witco Chemical Company Inc. of Dublin, Ohio under the tradename "Varisoft®137".

Biodegradable mono and di-ester variations of the quaternary ammonium compound can also be used, and are meant to fall within the scope of the present invention.

All percentages, ratios, and proportions herein are by weight unless otherwise specified.

Figure 1:
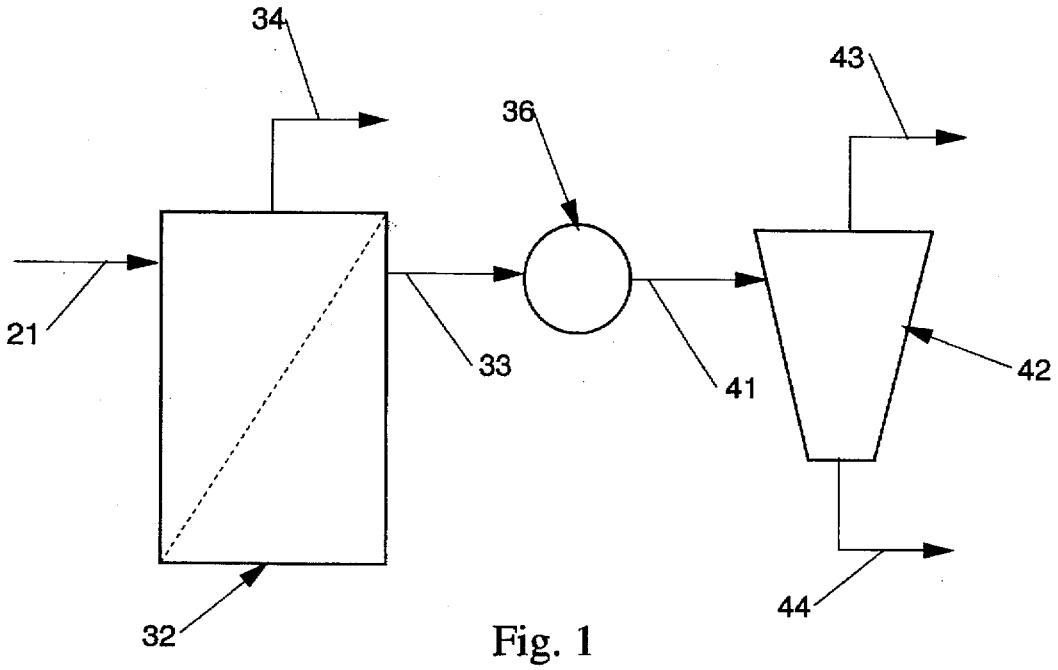
FIG. 1 is a schematic flow diagram depicting one method of producing preferred cellulose pulps wherein a length classifying stage is performed first, followed by a centrifuging stage.

The present invention is described in more detail below.

DETAILED DESCRIPTION OF THE INVENTION

Briefly, the present invention is a low extractives tissue paper comprising fibers possessing a coarseness within a certain range which has a heretofore unachieved level of softness when the range of coarseness of its furnish is taken into account.

It has been found that it is possible to achieve these unexpected softness levels by depressing the coefficient of friction of the surfaces of individual fibers in relation to their surface area.

The term coefficient of friction, as used herein refers to the coefficient of friction as determined from the force required to drag a fritted glass sled across the smooth surface of a paper specimen which has been prepared by TAPPI standard method T-205. Details of the method used for the measurement are provided hereinafter, however the coefficient of friction could be determined by other methods which produce comparable values.

The term depressed coefficient of friction, denoted by the acronym DCOF throughout this specification, and expressed in units of percentage points, refers to the percentage amount by which the coefficient of friction is depressed via the addition of the chemical softener. In other words, to measure the DCOF of a fiber furnish, a standard handsheet is prepared using a sample of the fibers without chemical softener and a standard handsheet is prepared using a sample of the fibers after addition of chemical softener. The coefficient of friction is measured using each handsheet, and the DCOF is computed using the following formula:

$$DCOF = \frac{COF_B - COF_A}{COF_B} \times 100$$

Where DCOF is the depressed coefficient of friction and $COF_B$ and $COF_A$ are the coefficient of friction of the handsheet made from untreated fibers and treated fibers respectively.

As used herein, the term chemical softener refers to a compound capable of increasing the lubricity of papermaking fibers while being essentially substantive to the fibers, i.e. will remain on the fibers even when the fibers are dispersed in water. The present invention preferably contains from about 0.05% to about 2.0% by weight, on a dry fiber basis, of a chemical softener.

A most preferred form of chemical softener is 0.05% to 2.0% of a quaternary ammonium compound having the formula:

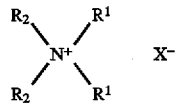

In the structure named above each $R_1$ is C14–C22 hydrocarbyl group, preferably tallow, $R_2$ is a C1–C6 alkyl or hydroxyalkyl group, preferably C1–C3 alkyl, $X^-$ is a compatible anion, such as an halide (e.g. chloride or bromide) or methyl sulfate. As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention.

Preferably, each $R_1$ is C16–C18 alkyl, most preferably each $R_1$ is straight-chain C18 alkyl. Preferably, each $R_2$ is methyl and $X^-$ is chloride or methyl sulfate.

Examples of quaternary ammonium compounds suitable for use in the present invention include the well-known dialkyldimethylammonium salts such as ditallowdimethylammonium chloride, ditallowdimethylammonium methyl sulfate, di(hydrogenated) tallow dimethyl ammonium chloride; with di(hydrogenated) tallow dimethyl ammonium methyl sulfate being preferred. This particular material is available commercially from Witco Chemical Company Inc. of Dublin, Ohio under the tradename "Varisoft® 137".

Further examples of suitable quaternary ammonium compounds, and preferred methods of adding such compounds to the cellulose fibers are described in U.S. Pat. No. 5,240,562, Phan et al., issued Aug. 31, 1993, and incorporated herein by reference.

Biodegradable mono and di-ester variations of the quaternary ammonium compound can also be used, and are meant to fall within the scope of the present invention. These compounds have the formula:

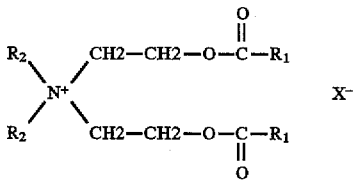

and

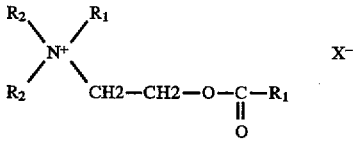

In the structures named above each $R_1$ is an aliphatic C13–C19 hydrocarbyl group, such as tallow, $R_2$ is a C1–C6 alkyl or hydroxyalkyl group or mixture thereof, $X^-$ is a compatible anion, such as an halide (e.g., chloride or bromide) or methyl sulfate. Preferably, each $R_1$ is C16–C18 alkyl, most preferably each $R_1$ is straight-chain C18 alkyl, and $R_2$ is a methyl.

Other preferred chemical softeners suitable for use in the tissue papers of the present invention include polysiloxane compounds, preferably amino-functional polydimethylpolysiloxane compounds. In addition to such substitution with amino-functional groups, effective substitution may be made with carboxyl, hydroxyl, ether, polyether, aldehyde, ketone, amide, ester, and thiol groups. Of these effective substituent groups, the family of groups comprising amino, carboxyl, and hydroxyl groups are more preferred than the others; and amino-functional groups are most preferred. Suitable types of such polysiloxanes are described in U.S. Pat. No. 5,059,282, Ampulski et al., issued Oct. 22, 1991, and incorporated herein by reference.

Exemplary commercially available polysiloxanes include DOW 8075 and DOW 200 which are available from Dow Corning; and Silwet L720 and Ucarsil EPS which are available from Union Carbide.

Still other preferred chemical softener additives suitable for the present invention include nonionic surfactants selected from alkylglycosides, including alkylglycoside esters such as Crodesta SL-40 which is available from Croda, Inc. (New York, N.Y.); alkylglycoside ethers as described in U.S. Pat. No. 4,011,389, issued to W. K Langdon, et al. on Mar. 8, 1977; alkylpolyethoxylated esters such as Pegosperse 200 ML available from Glyco Chemicals, Inc. (Greenwich, Conn.); alkylpolyethoxylated ethers and esters such as Neodol® 25-12 available from Shell Chemical Co.; sorbitan esters such as Span 60 from ICI America, Inc., ethoxylated sorbitan esters, propoxylated sorbitan esters, mixed ethoxylatedlpropoxylated sorbitan esters, and polyethoxylated sorbitan alcohols such as Tween 60 also from ICI America, Inc. It should be understood, that the above listings of suitable chemical softeners are intended to be merely exemplary in nature, and are not meant to limit the scope of the invention.

It has been found that the compounds such as the above mentioned quaternary ammonium compounds in such low amounts (i.e., from 0.05%–2.0%) carry a concomitant high economic value. In fact, in these low amounts, for the subject paper, it is not necessary to counteract any hydrophobicity through the use of polyhydroxy compounds or other wetting agents which would result in further savings.

As used herein, the term composite average coarseness, refers to the coarseness determined on the fibrous finished product of tissue, without regard as to whether the product is composed of several furnishes of different coarseness values. The method of determining coarseness of cellulose fibers is described in detail hereinafter.

The composite average coarseness can also be determined for a product comprised of a blend of different types of cellulose fibers from the coarseness of the individual fibers from which the product is comprised. The exact weight proportions of the different types of fibers needs to be known in order to perform this calculation. To do this, the following formula is used to determine the resultant composite average coarseness C when two fiber types, type 1 and type 2, possessing coarseness C1 and C2, respectively are blended in weight fractions f1 and f2, respectively:

$$C=\frac{C1*(1+f1/f2)}{1+(f2/f1)*(C1/C2)}$$

The tissue papers of the present invention are comprised of cellulose fibers having a composite average coarseness between about 11 and about 18 mg/100 m, more preferably, between about 12 mg/100 m and about 16 mg/100 m.

A preferred method for producing cellulose pulps having a desired combination of fiber length and fiber coarseness is described in U.S. Pat. No. 5,405,499, Vinson, issued Apr. 11, 1995, and incorporated herein by reference.

The term cellulose fibers, as used herein, refers to naturally-occurring fibrous material derived from wood or other biological material. Wood-derived materials are of particular interest. Cellulose wood fibers from a variety of sources may be employed to produce products according to the present invention. These include chemical pulps, which are purified to remove substantially all of the lignin originating from the wood substance. These chemical pulps include those made by either the alkaline Kraft (sulfate) or the acid, sulfite processes. Applicable wood fibers can also be derived from mechanical pulps, a term which as used herein, refers to chemi-thermomechanical as well as groundwood, thermomechanical, and semi-chemical pulps, all of which retain a substantial portion of lignin originating from the wood substance.

Both hardwood pulps and softwood pulps as well as blends of the two may be employed. The terms hardwood and softwood pulp as used herein refer to fibrous pulp derived from the woody substance of deciduous trees (angiosperms) and coniferous trees (gymnosperms), respectively. Also applicable to this invention are fibers derived from recycled paper, which may contain any or all of the above categories as well as minor amounts of other fibers, fillers, and adhesives used to facilitate the original papermaking.

Fibers derived from recycled paper made with chemical pulp fibers and comprising a blend of hardwood and softwood fibers may also be employed to produce products according to the present invention. The term "recycled paper", as used herein, generally refers to paper which has been collected with the intent of liberating its fibers and reusing them. These can be pre-consumer, such as might be generated in a paper mill or print shop, or post-consumer, such as that originating from home or office collection. Recycled papers are sorted into different grades by dealers to facilitate their reuse. One grade of recycled paper of particular value in the present invention is ledger paper. Ledger paper is usually comprised of chemical pulps and typically has a hardwood to softwood ratio of from about 1:1 to about 2:1. Examples of ledger papers include bond, book, photocopy paper, and the like.

Preferably, the cellulose fibers used to make the tissue paper of the present invention comprise at least 10%, and more preferably from about 20% to about 60% by weight, of coarse cellulose fibers selected from the group consisting of recycled fibers, chemi-thermomechanical fibers and mixtures thereof.

Softness, as used herein, refers to the tactile quality of a tissue paper, as judged relatively by expert panel and reported in average panel judging units.

Softness is known to be affected by structural artifacts of papermaking other than the fiber morphology as disclosed herein. For example, it is well known to those skilled in the art that softness of sanitary tissue is a function of its weight and tensile strength.

This is true of articles made according to the present invention as well. Inventors express the combination of these parameters as a ratio wherein the tensile strength, in g/in is divided by basis weight, in $g/m^2$. This ratio is referred to herein as the specific tensile strength. The specific tensile useful for the present invention ranges from about 9 $g/in/g/m^2$ to about 25 $g/in/g/m^2$, and, more preferably, from about 11 $g/in/g/m^2$ to 17 $g/in/g/m^2$.

Softness is further affected by the bulk resultant from the type of forming and drying performed in papermaking. For example, U.S. Pat. No. 3,301,746 issued to Sanford and Sisson in 1967 was pivotal in defining means of preparing exceptionally soft paper useful for sanitary tissues and the like. This art recognized the importance of density in providing softness.

The term density, as used herein, is calculated from the thickness and the weight per unit area, wherein the thickness is determined using any suitably calibrated caliper capable of subjecting the specimen to a uniform compressive load of 95 $g/in^2$. The density ranges useful for the present invention range from about 0.05 g/cc to about 0.2 g/cc, preferably from about 0.08 g/cc to about 0.15 g/cc.

As used herein, the term centrifugal screen refers to a pressure screen such as the Model 100 Centrisorter, a tradename of the Bird Machinery Corporation of South Walpole, Mass., equipped with a screen basket with hole size capable of separating the fibers in an inlet stream into two fractions having a measurable length difference.

The term fiber length, as used herein, refers to the weighted average fiber length as determined on the Kajaani FS-200, described in detail hereinafter. Preferably, the tissue papers of the present invention have a composite average fiber length between about 1 mm and about 1.5 mm.

The term hydraulic cyclone, as used herein, refers to a device such as a 3" Centricleaner, a tradename of the Sprout-Bauer Company of Springfield, Ohio.

As used herein the term "open cell wall" refers to a condition resulting when a native cellulose fiber having a lumen, or central void, is lengthwise sliced such that a substantial portion of the interior of the cell wall is exposed. The opposite of this condition is a "closed cell wall" which is the natural state of most cellulosic fibers, including in particular wood fiber tracheids, which constitute the primary mass of wood fibered pulps of both hardwood and softwood types. One of the principal advantages of the present invention is that it comprises fibers practically exclusively of the closed cell wall type.

A. Tissue Papers

The present invention is a soft tissue paper comprised of closed cell wall, chemically softened cellulose fibers. The chemically softened cellulose fibers comprise a sufficient amount of coarse fibers to raise the composite average coarseness of the tissue paper to between about 11 and about 18 mg/100 m, and more preferably between about 12 and about 16 mg/100 m. The chemically softened cellulose fibers have a depressed coefficient of friction (DCOF, in percentage points) related to the composite average coarseness (C), in mg/100 m, by the equation:

$$DCOF > 4.27*C - 44.23, \text{ more preferably,}$$

$$DCOF > 4.75*C - 44.23$$

The tissue paper has a specific tensile strength between about 9 and about 25 $g/in/g/m^2$ and a density between about 0.05 and about 0.20 g/cc The present invention is useful with tissue paper in general, including but not limited to conventionally felt-pressed tissue paper; high bulk pattern densified tissue paper; and high bulk, uncompacted tissue paper. The tissue paper can be of a homogenous or multi-layered construction; and tissue paper products made therefrom can be of a single-ply or multi-ply construction. The tissue paper preferably has a basis weight of between about 10 g/m2 and about 65 $g/m^2$, and density of about 0.6 g/cc or less. More preferably, the basis weight will be about 40 $g/m^2$ or less and the density will be about 0.3 g/cc or less. More preferably, the density will be between about 0.05 g/cc and about 0.2 g/cc, and most preferably, from about 0.08 g/cc to about 0.15 g/cc. See Column 13, lines 61–67, of U.S. Pat. No. 5,059,282 (Ampulski et al), issued Oct. 22, 1991, which describes how the density of tissue paper is measured. (Unless otherwise specified, all amounts and weights relative to the paper are on a dry basis.)

In one preferred embodiment of the present invention, the tissue papers are of a single ply, multi-layered construction. Preferably, the single ply comprises three superposed layers, an inner layer and two outer layers, with the inner layer being located between the two outer layers. The inner layer preferably comprises cellulose fibers with a length-weighted average length of at least about 1 mm, and each of the two outer layers preferably comprises fibers with a length-weighted average length less than about 1 mm. In this preferred embodiment the inner layer comprises from about 15% to about 35% of the total sheet weight. The coarse cellulose fibers are selected from a group consisting of recycled fibers, chemi-thermomechanical fibers and mixtures thereof. The coarse fibers are preferably located in the outer layers where they comprise at least about 10% and more preferably from about 20 to about 60% of the total sheet weight and at least about 12% and, more preferably from about 25 to about 75% by weight, of the outer layers.

Conventionally pressed tissue paper and methods for making such paper are well known in the art. Such paper is typically made by depositing a papermaking furnish on a foraminous forming wire, often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided from a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations wherein the web is subjected to pressure developed by opposing mechanical members, for example, cylindrical rolls. The dewatered web is then further pressed and dried by a steam drum apparatus known in the art as a Yankee dryer. Pressure can be developed at the Yankee dryer by mechanical means such as an opposing cylindrical drum pressing against the web. Multiple Yankee dryer drums can be employed, whereby additional pressing is optionally incurred between the drums. The tissue paper structures that are formed are referred to hereafter as conventional, pressed, tissue paper structures. Such sheets are considered to be compacted since the entire web is subjected to substantial mechanical compressional forces while the fibers are moist and are then dried while in a compressed state.

Preferably, the tissue papers of the present invention are pattern densifted. Pattern densifted tissue paper is characterized by having a relatively high bulk field of relatively low fiber density and an array of densifted zones of relatively high fiber density. The high bulk field is alternatively characterized as a field of pillow regions. The densifted zones are alternatively referred to as knuckle regions. The densifted zones are dispersed within the high bulk zone. The densifted zones can be discretely spaced within the high bulk field or can be interconnected, either fully or partially, within the high bulk field. The patterns can be formed in a nonornamental configuration or can be formed so as to provide an ornamental design(s) in the tissue paper. Preferred processes for making pattern denified tissue webs are disclosed in U.S. Pat. No. 3,301,746 (Sanford et al), issued Jan. 31, 1967; U.S. Pat. No. 3,974,025 (Ayers), issued Aug. 10, 1976; and U.S. Pat. No. 4,191,609 (Trokhan) issued Mar. 4, 1980; and U.S. Pat. No. 4,637,859 (Trokhan) issued Jan. 20, 1987, all of which are incorporated by reference.

In general, pattern densified webs are preferably prepared by depositing a papermaking furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer, or by mechanically pressing the web against the array of supports. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones can be integrated or partially integrated to reduce the total number of processing steps performed. Subsequent to formation of the densifted zones, dewatering, and optional predrying, the web is dried to completion, preferably still avoiding mechanical pressing. Preferably, from about 8% to about 55% of the tissue paper surface comprises densified knuckles having a relative density of at least 125% of the density of the high bulk field.

The array of supports is preferably an imprinting carrier fabric having a patterned displacement of knuckles that operate as the array of supports that facilitate the formation of the densifted zones upon application of pressure. The pattern of knuckles constitutes the array of supports previously referred to. Suitable imprinting carrier fabrics are disclosed in U.S. Pat. No. 3,301,746 (Sanford et al), issued Jan. 31, 1967; U.S. Pat. No. 3,821,068 (Salvucci et al), issued May 21, 1974; U.S. Pat. No. 3,974,025 (Ayers), issued Aug. 10, 1976; U.S. Pat. No. 3,573,164 (Friedberg et al.), issued Mar. 30, 1971; U.S. Pat. No. 3,473,576 (Amneus), issued Oct. 21, 1969; U.S. Pat. No. 4,239,065 (Trokhan), issued Dec. 16, 1980; and U.S. Pat. No. 4,528,239 (Trokhan), issued Jul. 9, 1985, all of which are incorporated by reference.

Preferably, the furnish is first formed into a wet web on a foraminous forming carrier, such as a Fourdrinier wire. The web is dewatered and transferred to an imprinting fabric. The furnish can alternately be initially deposited on a foraminous supporting carrier that also operates as an imprinting fabric. Once formed, the wet web is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll that supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure can be applied to induce impression of densified zones during initial dewatering, in a separate, subsequent process stage, or a combination thereof.

Uncompacted, nonpattern-densified tissue paper structures are described in U.S. Pat. No. 3,812,000 (Salvucci et al), issued May 21, 1974 and U.S. Pat. No. 4,208,459 (Becker et al), issued Jun. 17, 1980, both of which are incorporated by reference. In general, uncompacted, nonpattern-densified tissue paper structures are prepared by depositing a papermaking furnish on a foraminous forming wire such as a Fourdrinier wire to form a wet web, draining the web and removing additional water without mechanical compression until the web has a fiber consistency of at least about 80%, and creping the web. Water is removed from the web by vacuum dewatering and thermal drying. The resulting structure is a soft but weak, high bulk sheet of relatively uncompacted fibers. Bonding material is preferably applied to portions of the web prior to creping.

Compacted non-pattern-densified tissue structures are commonly known in the art as conventional tissue structures. In general, compacted, non-pattern-densified tissue paper structures are prepared by depositing a papermaking furnish on a foraminous wire such as a Fourdrinier wire to form a wet web, draining the web and removing additional water with the aid of a uniform mechanical compaction (pressing) until the web has a consistency of 25–50%, transferring the web to a thermal dryer such as a Yankee and creping the web. Overall, water is removed from the web by vacuum, mechanical pressing and thermal means. The resulting structure is strong and generally of singular density, but very low in bulk, absorbency and softness.

B. Coarseness, Fiber Length, and Percentage Softwood Determination

The term "average fiber length, as used herein, refers to the length weighted average fiber length as determined with a suitable fiber length analysis instrument such as a Kajaani Model FS-200 fiber analyzer available from Kajaani Electronics of Norcross, Ga. The analyzer is operated according to the manufacturer's recommendations with the report range set at 0 mm to 7.2 mm and the profile set to exclude fibers less than 0.2 mm in length from the calculation of fiber length and coarseness. Particles of this size are excluded from the calculation because it is believed that they consist largely of non-fiber fragments which are not functional for the uses toward which the present invention are directed.

The term "coarseness", abbreviated "C" in the algebraic formulae contained herein, refers to the fiber mass per unit of unweighted fiber length reported in units of milligrams per ten meters of unweighted fiber length (mg/100 m) as measured using a suitable fiber coarseness measuring device such as the above mentioned Kajaani FS-200 analyzer. The coarseness C of the pulp is an average of three coarseness measurements of three fiber specimens taken from the pulp. The operation of the analyzer for measuring coarseness is similar to the operation for measuring fiber length. Care must be taken in sample preparation to assure an accurate sample weight is entered into the instrument.

An acceptable method is to dry two aluminum weighing dishes for each fiber specimen in a drying oven for thirty minutes at 110° C. The dishes are then placed in a desiccator having a suitable desiccant such as anhydrous calcium sulfate for at least fifteen minutes to cool. The dishes should be handled with tweezers to avoid contaminating them with oil or moisture. The two dishes are taken out of the desiccator and immediately weighed together to the nearest 0.0001 gram.

Approximately one gram of a fiber specimen is placed in one of the dishes, and the two dishes (one empty) are placed uncovered in the drying oven for a period of at least sixty minutes at 110° C. to obtain a bone dry fiber specimen. The dish with the fiber specimen is then covered with the empty dish prior to removing the dishes from the oven. The dishes and specimen are then removed from the oven and placed in a desiccator for at least 15 minutes to cool. The covered specimen is removed and immediately weighed with the dishes to within 0.0001 gram. The previously obtained weight of the dishes can be subtracted from this weight to obtain the weight of the bone dry fiber specimen. This weight of fiber is referred to as the initial sample weight.

An empty 30 liter container is prepared by cleaning it and weighing it on a scale capable of at least 25 kilograms capacity with 0.01 gram accuracy. A standard TAPPI disintegrator, such as the British disintegrator referred to in TAPPI method T205, is prepared by cleaning its container to remove all fibers. The initial sample weight of fibers is emptied into the disintegrator container, ensuring that all fibers are transferred to the disintegrator.

The fiber sample is diluted in the disintegrator with about 2 liters of water and the disintegrator is run for ten minutes. The contents of the disintegrator are washed into the 30 liter container, ensuring that all fibers are washed into the container. The sample in the 30 liter container is then diluted with water to obtain a water-fiber slurry weighing 20 kilograms, within 0.01 gram.

The sample beaker for the Kajaani FS-200 is cleaned and weighed to within 0.01 gram. The slurry in the 30 liter container is stirred with vertical and horizontal strokes, taking care to not set up a circular motion which would tend to centrifuge the fibers in the slurry. A 100.0 gram measure accurate to within 0.1 gram is transferred from the 30 liter container to the Kajaani beaker. The fiber weight in the Kajaani beaker, in milligrams, is obtained by multiplying five (5) times the initial sample weight (as recorded in grams).

This fiber weight, which is accurate to 0.01 mg, is entered into the Kajaani FS-200 profile. A minimum fiber length of 0.2 mm is entered into the Kajaani profile so that 0.2 mm is the minimum fiber length considered in the coarseness calculation. A preliminary coarseness is then calculated by the Kajaani FS-200.

The coarseness is obtained by multiplying this preliminary coarseness value by a factor corresponding to the weight weighted cumulative distribution of fibers with length greater than 0.2 mm. The FS-200 instructions provide a method for obtaining this weight weighted distribution. However, the values are reported as a percentage and are accumulated beginning at "0" fiber length. To obtain the factor described above, the "weight-weighted cumulative distribution of fibers with length less than 0.2 mm" (which is provided as an output of the instrument) is obtained from the instrument display. This display value is subtracted from 100, and the result is divided by 100 to obtain the factor corresponding to the weight weighted cumulative distribution of fibers with length greater than 0.2 mm. The resulting coarseness is therefore a measure of the coarseness of those fibers in a fiber sample having a fiber length greater than 0.2 mm. The coarseness measurement is repeated, starting with oven drying two weighing dishes and a fiber specimen, to obtain three values of coarseness. The value of coarseness C used herein is obtained by averaging the three coarseness values and converting the units to express the value in mg/100 m.

The quantity "percentage softwood", as used herein, refers to the dry weight percentage of fibers in a cellulose pulp which are derived from softwood trees. The remainder of the cellulosic pulp (100-% softwood) is defined as the "percentage hardwood". If unknown, the percentage softwood can be determined by optical observation by the methodology of TAPPI T401 om-88, "Fiber Analysis of Paper and Paperboard," incorporated herein by reference.

C. Minimum Fiber Surface Area and Fiber Incremental Surface Area Determination

The term "minimum fiber surface area" as used herein refers to the projected surface area of the smallest surface area fiber in the group of fibers comprising the largest one percent (by surface area) of fibers in a pulp specimen. This minimum fiber surface area can be measured by image analysis as described below.

About 0.25 gm of a representative pulp specimen is moistened and shredded into pieces. The use of distilled and filtered water is recommended to reduce contaminants which would otherwise complicate image analysis. A 0.05 micron filter is sufficient to reduce such contaminants. The shredded pulp is placed in a 250 ml Erlenmeyer flask, about 50 ml of water is added, and the flask is shaken until the pulp specimen is disintegrated. The flask contents are then diluted to 200 ml volume with water. About three quarters of the flask contents are discarded, the flask is refilled to 200 ml volume, and the flask is again shaken to mix the contents. This cycle of discarding the flask contents, rediluting the flask contents, and shaking the flask is repeated until visual inspection of the flask contents indicates the resulting slurry in the flask is free of fiber to fiber contacts.

A 40×60 mm glass microscope slide is cleaned with a non-linting tissue and is prepared by marking an orthogonal grid on one surface of the slide using a permanent marker. The grid is used as a reference during the subsequent image analysis; its precise spacing is not critical and can be set at a convenient size by the operator. About one square centimeter grids are used to reduce the occurrence of fiber/grid line intersections. The slide is placed on a slide warmer, marker side "down". The slurry in the flask is shaken vigorously, and an aliquot of the slurry is removed with a disposable pipette, and deposited onto the slide. The slide should be covered with about 10 milliliters of slurry. The water on the slide is allowed to evaporate, and the surface tension is broken occasionally with a dissecting needle to prevent flocculating of the slurry fibers during the drying. Small drops of slide adhesive are placed at the four corners of a fresh slide, which is placed against the fiber-covered slide taking care not to apply excessive pressure. Excess adhesive is removed and the .slide surfaces are cleaned with a non-linting tissue.

The image analysis system includes a computer having a frame grabber board, a stereoscope, a video camera, and image analysis software. A suitable frame grabber board includes a TARGA Model M8 board available from the Truevision Company, of Indianapolis, Ind. Alternatively, a Model DT2855 frame grabber board available from Data Translation of Marlboro, Mass. can be employed.

An Olympus SZH stereoscope available from the Olympus Corporation of Lake Success, N.Y., and a Kohu Model 4815-5000 solid state CCD video camera available from the Kohu Electronics Division of San Diego, Calif., can be used to acquire an image to be saved to a computer file. An Olympus Model MTV-3 adapter can be used to mount the Kohu video camera to the stereoscope. Alternatively, a VH5900 monitor microscope and a video camera having a VH50 lens with a contact type illumination head, available from the Keyence Company of Fair Lawn, N.J., can be used. The stereoscope and video camera acquire the image to be recorded. The frame grabber board converts the analog signal of this image to a digital format readable by the computer.

The image saved to the computer file is measured using suitable software such as the Optimas Image Analysis software, version 3.0, available from the BioScan Company of Edmonds, Wash. The Optimas software will run on any Windows compatible IBM PC AT or compatible computer, as well as on IBM PS/2 Microchannel systems. A suitable computer is an IBM compatible personal computer having an expansion slot for the frame grabber board, an Intel 80386 CPU, 8 megabytes of RAM, 200 megabytes of hard disk storage space, and DOS, version 3.0 or later, installed. The computer should have Windows, version 3.0 or later, installed available from the Microsoft Corporation of Redmond, Wash. Images saved to and recalled from file can be displayed on a Sony Model PVM-1271Q or Model PVM-1343MO video monitor.

The slide is placed on the stereoscope stage. The stereoscope is adjusted to a 15× magnification level. The stereoscope light source intensity is set to the maximum value, and the stereoscope aperture is set to the minimum aperture size in order to obtain the maximum image contrast. The Optimas software is run with the multiple mode set and ARAREA (area) and ARLENGTH (length) measurements selected. Under "Sampling Options," the following default values are used: sampling units are selected, set number equals 64 intervals, and minimum boundary length is 10 samples. The following options are not selected: Remove Areas Touching Region of Interest (ROI), Remove Areas Inside Other Areas, and Smooth Boundaries. The software contrast and brightness settings are set to 0 and 170, respectively. The software threshold settings are set to 125 and 255. The image analysis software is calibrated in millimeters with a metric ruler placed in the field of view. The calibration is performed to obtain a screen width of 6.12 millimeters.

The region of interest is selected so that no fibers intersect the boundary of the region of interest. The operator positions the slide and acquires the image data (area and length) in one field. The slide is then repositioned, and image data are acquired in a second field. Data collection is continued until data from the entire slide is acquired. The use of grid lines on the slide, while not essential, is highly useful to prevent the microscopist from missing an area or reading an area more than once. Fibers crossing the grid lines are not included in the data collection.

While it is desirable to have a slide composed solely of individual fibers which do not cross, inevitably some images comprised of crossed fibers will be created. Crossed fiber images are deleted with the paint option available in the Optimas software if none of the crossed fibers are unobstructed. Unobstructed fibers in crossed fiber images are retained by painting over those fibers in the crossed fiber image which are at least partially obstructed by other fibers.

The image analysis software provides the projected fiber surface area and the fiber length for each fiber image recorded with the image analysis system. The fiber images can be ranked by fiber length and by fiber surface area. The use of spreadsheet software, such as Microsoft Excel version 3.0, is useful but not required to perform such data manipulation. After ranking the fibers by length, the fiber image data for those fibers having a length less than 0.25 mm is deleted. At least 500 fiber images should remain. The remaining fiber image data is then rank ordered based on projected fiber surface area, and each fiber image is assigned a number according to its ranking. The fiber image having the largest projected surface area is ranked number one.

The minimum fiber surface area as used herein can be described as follows. The number of remaining fiber images is multiplied by 0.01 (1%) to obtain a fiber image number. If the product of the multiplication is not an integer, the product should be rounded to the nearest whole number. The projected surface area of the fiber image having this number corresponds to the minimum fiber surface area.

While descriptive of the "minimum fiber surface area", this method requires a large number of images (more than 1000) to establish statistical significance. Therefore, a preferred method is recommended. This preferred method consists of obtaining the projected surface area of the remaining fiber images at the intervals 1%, 3%, 5%, 10%, and 20%. Linear regression of the projected surface area as a function of the logarithm of percentage and interpolation of the resultant function to the projected surface area at the 1% mark provides the value of minimum fiber surface area with statistical validity sufficient for the use as described herein provided sufficient fiber images are acquired to leave at least 500 fiber images after the image rejection based on fiber length described earlier.

The term "incremental surface area", as used herein, is defined as the minimum fiber surface area as determined by the preferred method described above, decreased by 0.0022 square millimeter for each percentage point of softwood contained in the specimen being considered. The correction applied to convert the minimum fiber surface area to incremental surface area compensates for the widely differing surface areas of softwoods versus hardwoods, so that a single value of surface area can be used to gage the uniformity of a pulp specimen regardless of the hardwood and softwood content of the specimen being considered. As previously discussed, uniformity in fiber properties is believed to offer benefits independent of the average properties. A pulp specimen having relatively highly non-uniform fiber properties will have a relatively high value of incremental surface area. The incremental surface area provides an index of the level of uniformity of fiber properties possessed by a given specimen of cellulose fibers.

D. Coefficient of Friction

The coefficient of friction is obtained using a KES-4BF surface analyzer with a modified friction probe as described in "Methods for the Measurement of the Mechanical Properties of Tissue Paper", Ampulski, et. al., 1991 International Paper Physics Conference, published by TAPPI press, and incorporated herein by reference.

The substrate used for the friction evaluation, as disclosed herein, is a laboratory prepared handsheet, prepared according to TAPPI standard T-205 incorporated herein by reference. The friction is measured on the smooth side of the handsheet (the side which is dried against a metal plate according to the method).

The substrate is advanced at 1 mm/sec constant rate for the measurement and the friction probe is modified from the standard instrument probe to a two centimeter diameter 40–60 micron glass frit.

When using a 12.5 g normal force on the probe and the heretofore specified translation rate for the substrate, the coefficient of friction can be calculated by dividing the frictional force by the normal force. The frictional force is the lateral force on the probe during the scanning, an output of the instrument.

The average of coefficient of friction obtained by a single scan in the forward direction and a single scan in the reverse direction is reported as the coefficient of friction for the specimen.

Therefore, to measure the depressed coefficient of friction of a fiber furnish, a standard handsheet is prepared using a sample of the fibers without chemical softener and a standard handsheet is prepared using a sample of the fibers after addition of the chemical softener. The coefficient of friction is measured using each handsheet, and the DCOF is computed using the following formula:

$$DCOF = \frac{COF_B - COF_A}{COF_B} \times 100$$

Where DCOF is the depressed coefficient of friction and $COF_B$ and $COF_A$ are the coefficient of friction of the handsheet made from untreated fibers and those from fibers treated with chemical softener, respectively.

E. Coarse Cellulose Fibers

The term "coarse cellulose fibers", as used herein, refers to fibers having a coarseness greater than about 11 mg/100 m while having an average fiber length less than about 1.5 mm. While many suitable sources of coarse cellulose fibers can be applied to make tissue paper according to the present invention, two embodiments are preferred for its practice.

One preferred embodiment employs a chemi-thermomechanical pulp derived from hardwood fibers, such as Aspen CTMP.

A second preferred embodiment employs recycled fibers. If recycled fibers are employed in the present invention, it is preferred that they be pre-conditioned according to the following process steps to most favorably dispose them to the product use.

These include the two basic arrangements of two stage fractionating processes comprising a length classifying stage and a centrifuging stage.

FIG. 1 is a flow diagram depicting one arrangement which can be used to produce cellulose pulps preferred for use in the tissue papers of the present invention. In this arrangement, the length classifying stage is performed first, followed by the centrifuging stage.

In FIG. 1, an aqueous slurry 21 comprising wood pulp fibers is directed to form the input stream to a length classifying stage 32. A satisfactory length classifier is a centrifugal pressure screen such as a Bird "Centrisorter" manufactured by the Bird Escher Wyss Corporation of South Walpole, Mass. The slurry 21 is processed in the length classifying stage 32 to provide an accepts stream 33 of the classifying stage 32 and a rejects stream 34 of the classifying stage 32. The rejects stream 34 comprises fibers having an average fiber length exceeding that of the fibers in the accepts stream 33. The length classifying stage 32 is configured and operated as described below to provide the accepts stream 33 having an average fiber length which is at least 20%, and preferably at least 30% less than the average fiber length of the rejects stream comprising slurry 34. The fibers in rejects stream 34 are directed to alternative end uses where the characteristics sought as objectives of the present invention are less valued. In this regard they may be blended with other rejects streams, maintained separate or discarded.

Without being limited by theory, the fiber weight of the accepts stream 33 of the length classifying stage 32 should be between about 30 to 70 percent of the fiber weight of the input stream to the length classifying stage 32, so that there is about a thirty to seventy percent mass split of the fibers entering the length classifying stage 32 between the accepts stream 33 and the rejects stream 34. Such a mass split is desirable to ensure that length classifying stage 32 functions to fractionate the input stream by fiber length, rather than just functioning to remove debris such as knots and shives from the input stream.

At least a portion of the accepts stream 33 of the length classification stage 32 is directed as shown in FIG. 1 to provide an input stream 41 to a second fractionation stage comprising a centrifuging stage 42. A satisfactory centrifuging stage 42 comprises one or more hydraulic cyclones, such as 3 inch "Centricleaner" hydraulic cyclones manufactured by the CE Bauer Company of Springfield, Ohio.

For best operation of the centrifuging stage 42, it may be necessary to adjust the consistency of the input stream 41 to the centrifuging stage 42 prior to processing the input stream 41 in the centrifuging stage 42. For instance, if it is desirable to remove water from input stream 41 to increase the consistency of input stream 41, a suitable sieve 36 can be positioned intermediate the length classifying stage 32 and the centrifuging stage 42, as illustrated in FIG. 1. A suitable sieve 36 comprises a CE Bauer "Micrasieve" equipped with a 100 micron screen.

The centrifuging stage 42 processes input stream 41 to provide an accepts stream 43 of the centrifuging stage 42 and a rejects stream 44 of the centrifuging stage 42. The accepts stream 43 exits the overflow side of the hydraulic cyclone and the rejects stream 44 exits the underflow side (the "tip") of the hydraulic cyclone.

When the process depicted in FIG. 1 is operated according to the present invention, the normalized coarseness of the fibers in accepts stream 43 is at least 3 percent, and preferably at least 10 percent less than that of the fibers in the rejects stream 44 of the centrifuging stage 42. The process depicted in FIG. 1 can be operated to provide an accepts stream 43 comprising the cellulose pulps preferred for the present invention.

The accepts stream 43 comprising the cellulose pulps of the present invention includes at least 10 percent softwood fibers, has an incremental surface area less than 0.085 square millimeters, and has a coarseness related to average fiber length by the algebraic expression recited above. The average fiber length of the accepts stream 43 is preferably about 0.70 mm to about 1.1 mm, and more preferably about 0.75 mm to about 0.95 mm to provide this coarseness to fiber length relationship.

The fiber weight of the accepts stream 43 of the centrifuging stage 42 should be between about 30 to 70 percent of the fiber weight of the input stream 41 to the centrifuging stage 42, so that there is about a thirty to seventy percent mass split of the fibers entering the centrifuging stage 42 between the accepts stream 43 and the rejects stream 44, respectfully. Such a mass split is desirable to ensure that the centrifuging stage 42 provides an accept stream 43 having a reduced normalized coarseness relative to rejects stream 44, rather than just functioning to remove debris such as knots and shives from the input stream 41.

Figure 2:
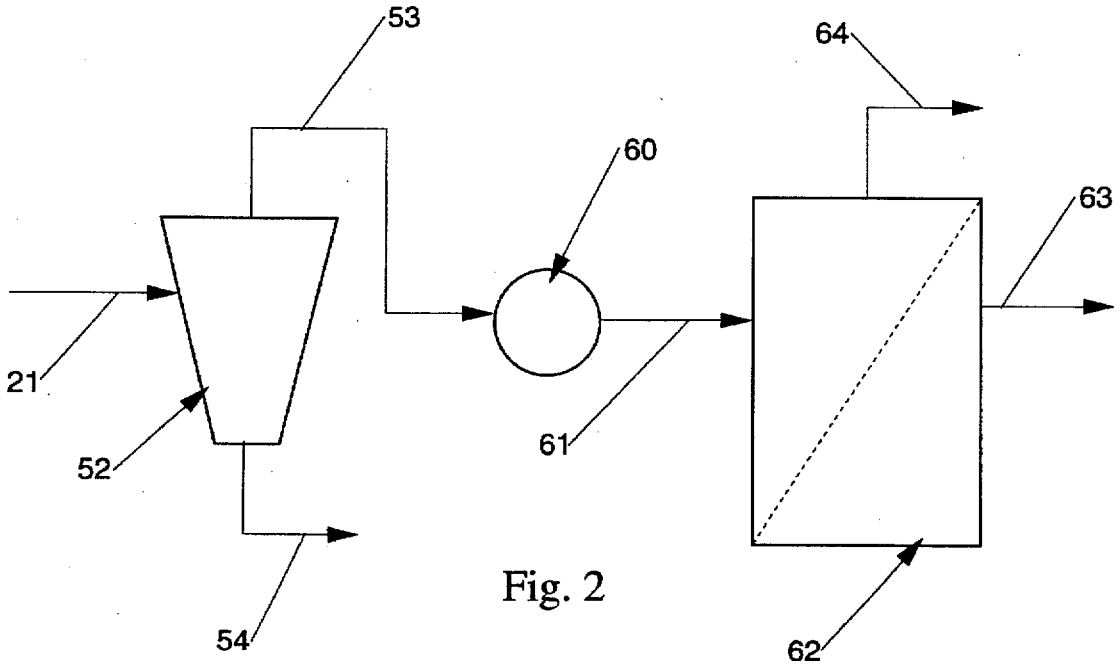
FIG. 2 is a schematic flow diagram depicting an alternate method of producing preferred cellulose pulps wherein a centrifuging stage is performed first, followed by a length classification stage.

FIG. 2 is a flow diagram depicting another arrangement which can be used to produce cellulose pulps preferred for use in the tissue papers of the present invention. In this arrangement, the centrifuging stage is performed first, followed by the length classifying stage.

In FIG. 2, an aqueous slurry 21 comprising wood pulp fibers is first directed to form the input stream to the centrifuging stage 52. The centrifuging stage 52 comprises at least one hydraulic cyclone. The centrifuging stage 52 processes the input stream to provide an accepts stream 53 of the centrifuging stage 52 and a rejects stream 54 of the centrifuging stage 52. The accepts stream 53 exits the overflow side of the hydraulic cyclone, and the rejects stream exits the under flow side (the tip) of the hydraulic cyclone. When operated according to the present invention, the normalized coarseness of the fibers in accepts stream 53 is at least 3 percent, and preferably at least 10 percent less than that of the fibers in the rejects stream 54 of the centrifuging stage 52, and the average fiber length of the fibers in the accepts stream 53 is preferably about equal to or greater than that of the slurry 21.

At least a portion of the accepts stream 53 of the centrifuging stage 52 is directed to provide an input stream 61 to a length classifying stage 62. The length classifying stage 62 can comprise a screen, such as the centrifugal screen described above. It may be desirable to adjust the consistency of the input stream 61 prior to processing the input stream 61 in the length classifying stage 62. For instance, if it is desirable to remove water from input stream 61 to increase its consistency, a suitable sieve 60 can be positioned intermediate the centrifuging stage 52 and the length classifying stage 62 as illustrated in FIG. 2. A suitable sieve 60 comprises a CE Bauer "Micrasieve" equipped with a 100 micron screen.

The length classifying stage 62 processes input stream 61 to provide an accepts stream 63 of the length classifying stage and a rejects stream 64 of the length classifying stage. The rejects stream 64 comprises fibers having an average fiber length exceeding that of the fibers in the accepts stream 63. The average fiber length is at least 20 percent less, and preferably at least 30 percent less than the average fiber length of the rejects stream 64 to the length classification stage.

The process depicted in FIG. 2 can be operated to provide an accepts stream 63 comprising the cellulose pulps preferred for the present invention. The accepts stream 63 comprising the cellulose pulps of the present invention includes at least 10 percent softwood fibers, has an incremental surface area less than 0.085 square millimeters, and has a coarseness related to average fiber length by the algebraic expression recited above. The average fiber length of the accepts stream 63 is preferably about 0.7 mm to about 1.1 mm, and more preferably about 0.75 mm to about 0.95 mm to provide the aforementioned coarseness to fiber length relationship.

The operating parameters of the length classification and centrifuging stages can be adjusted for the specific characteristics of the fibers contained in slurry 21 in order to achieve the necessary change in the average fiber length and normalized coarseness respectively required by the present invention. For the embodiment wherein the length classification stage comprises a centrifugal screen, such operating parameters include the consistency of the input and output slurry; the size, shape, and density of perforations in the screen media; the speed at which the screen pulsator rotates; and the flow rates of the inlet and each of the outlet streams.

It may also be desirable to use dilution water to aid in the removal of the longer fiber rejects stream from the screen in the sieve 60 if it tends to be excessively thickened by the action of the screen. For the embodiment wherein the centrifuging stage comprises a hydraulic cyclone, examples of operating parameters include the consistency of the input stream, the diameter of the cone, the cone angle, the size of the underflow opening, and the pressure drop from the inlet slurry to each leg of the outlet.

F. Fiber Treatment with Chemical Softener

The present invention requires that the cellulose fibers possess a depressed coefficient of friction achieved via the addition of a chemical softener.

The preferred method of adding the chemical softener to the cellulose fibers is to add the softener to an aqueous slurry of papermaking fibers, or furnish, in the wet end of the papermaking machine at some suitable point ahead of the fourdrinier wire or sheet forming stage. However, since the chemical softeners within the scope of this invention are expressly substantive to the fibers, applications of the chemical softeners prior to the papermaking process, for example by adding to aqueous pulp mixtures formed during production of the pulp are also anticipated. In addition, chemical softener application subsequent to the formation of the tissue web, including points prior to, during, or after drying can also be designed to meet the requirements of the present invention and are expressly included within its scope.

The following examples illustrate the practice of this invention, but are not intended to be limiting thereof.

EXAMPLE 1

This example illustrates the preparation of a single-ply bath tissue product utilizing a recycled fiber source normally regarded as being inferior for making this type of product.

The cellulose fiber types used in the preparation are:

Northern Softwood Kraft (NSK) pulp, eucalyptus hardwood Kraft pulp and a market recycled pulp, obtained from Ponderosa Fibers' Oshkosh, Wis. mill.

The virgin Kraft pulps are used as delivered, while the Ponderosa pulp is pre-treated by forming an aqueous slurry and subjecting it to a sequential treatment in a centrifugal screen from which a short fiber fraction is acquired which is then passed through a hydraulic cyclone, from which the accepts or overflow fraction is captured.

The screening accepts are about 25% of the feed material and have a fiber length about 50% lower than the starting pulp. A single-pass through the cyclones is taken at about 75 psi pressure drop from inlet to accepts and 0.1% solids in the feed. The accepts accordingly comprise about 50% of the fiber which is fed to them. This step is known from previous work to result in a fiber with exceptionally low coarseness as a function of its fiber length as illustrated by the following measurements.

Percent Softwood: 24%

Coarseness: 12.3 mg/100 m

Average Fiber Length: 0.92 mm

Minimum Fiber Surface Area: 0.130 square millimeters

Using these measurements, the incremental surface area can be calculated as 0.130–24*0.0022=0.077 square millimeters.

The resultant tissue product is formed so that it conforms to the practice of the present invention, as follows:

The papermaking is done on a pilot scale Fourdrinier papermaking machine. This papermaking machine is operated with enough whitewater purge to assure that essentially no non-substantive additives will remain in the papermaking web after draining on the forming wire.

First a 1% solution of a quaternary salt (dihydrogenated tallow dimethyl ammonium methyl sulfate), obtained from Witco Chemical Company of Dublin, Ohio. is prepared. To aid in the preparation of this solution, an equivalent amount of polyethylene glycol of 400 molecular weight is optionally included. The quaternary salt, with the PEG optionally added, are first heated to about 150° F., then added to water at about the same temperature while the water is being agitated.

The papermaking headbox is equipped with separator leaves so that long NSK fibers and the shorter eucalyptus or recycled fibers can be laid down in separate layers to deposit each fiber type in its optimum location. This type of forming is common and will be recognized as such by those skilled in the art.

Two comparative paper structures are formed.

The first is formed by directing 20% of the sheet weight as NSK into the center layer of a three-layered composite wherein the outer layers are comprised exclusively of the eucalyptus pulp.

The second is formed by directing 20% of the sheet weight as NSK into the center layer of a three-layered composite wherein the outer layer next to the forming wire is comprised exclusively of the pre-treated recycled pulp, and the other outer layer is comprised of a blend of the pre-treated recycled pulp with eucalyptus in a proportion of 3:5 by weight. The overall content of the recycled pulp is therefore 55%.

Otherwise, the forming is completed similarly on the two furnishes. When forming the structure comprised of the recycled pulp, the quaternary salt is added to the stocks during approach flow when their consistencies are about 3%. The quaternary salt is proportioned so that the ratio added to the wire-side furnish is twice that of the felt side furnish. No quaternary salt is added to the NSK. The amount of quaternary salt added is sufficient to retain 0.105% in the finished product. The only other change necessary in the process when using the recycled fiber, is a slight refining of the NSK to compensate for some strength losses.

Since the composite coarseness of this product is known to be between 11 and 18 mg/100 m, and the level of treatment with the quaternary salt is sufficient to result in a depression of coefficient of friction (DCOF) of more than 4%, the product made in accordance with this example meets the requirements laid out by this invention.

Confirmation is gained when the product containing the recycled fibers is judged softer by a panel of expert softness judges.

EXAMPLE 2

This example illustrates the preparation of a single-ply bath tissue product utilizing a chemi-thermomechanical fiber source normally regarded as being inferior for making this type of product.

The cellulose fiber types used in the preparation are:

Northern Softwood Kraft (NSK) pulp, eucalyptus hardwood Kraft pulp and a market hardwood CTMP pulp, designated as 86 brightness/350 freeness by the manufacturer which is the Quesnel River Pulp and Paper Company.

The pulps are all used as delivered and the resultant tissue product is formed so that it conforms to the practice of the present invention.

The papermaking is done on a pilot scale Fourdrinier papermaking machine. This papermaking machine is operated with enough water purge so that essentially no non-substantive additives will remain in the papermaking web after draining on the forming wire.

First a 1% solution of a quaternary salt (diester dihydrogenated tallow dimethyl ammonium chloride), obtained from Witco Chemical Company of Dublin, Ohio. is prepared. To aid in the preparation of this solution, an equivalent amount of polyethylene glycol of 400 molecular weight is optionally included. The quaternary salt, with the PEG optionally added, are first heated to about 185° F., then added to water at about the same temperature while the water is being agitated.

The papermaking headbox is equipped with separator leaves so that long NSK fibers and the shorter eucalyptus or recycled fibers can be laid down in separate layers to deposit each fiber type in its optimum location. This type of forming is common and will be recognized as such by those skilled in the art.

Two comparative paper structures are formed.

The first is formed by directing 20% of the sheet weight as NSK into the center layer of a three-layered composite wherein the outer layers are comprised exclusively of the eucalyptus pulp.

The second is formed by directing 20% of the sheet weight as NSK into the center layer of a three-layered composite wherein the outer layers are supplied by a furnish comprising a blend of eucalyptus and CTMP in proportions of 7:4. The overall content of the CTMP pulp is therefore 28%.

Otherwise, the forming is completed similarly on the two furnishes. When forming the structure comprised of the CTMP pulp, the quaternary salt is added to the stocks during approach flow when their consistencies are about 3%. The quaternary salt is proportioned so that the ratio added to the wire-side furnish is half that of the felt side furnish. No quaternary salt is added to the NSK. The amount of quaternary salt added is sufficient to retain 0.325% in the finished product. The only other change necessary in the process when using the CTMP fiber, is a slight refining increase of the NSK to compensate for some strength losses.

Since the composite coarseness of this product is known to be between 11 and 18 mg/100 m, the CTMP pulp is known to possess a fiber incremental surface area less than 0.085 square millimeters, and the level of treatment with the quaternary salt is sufficient to result in a depression of coefficient of friction (DCOF) of more than 10%, the product made in accordance with this example meets the requirements laid out by this invention.

Confirmation is gained when the product containing the CTMP fibers is judged softer by a panel of expert softness judges.

What is claimed is:

1. A soft tissue paper comprised of closed cell wall, chemically softened cellulose fibers, said fibers comprised of a sufficient amount of coarse fibers to raise the composite average coarseness of the tissue paper to between about 11 mg/100 m and about 18 mg/100 m, wherein said chemically softened cellulose fibers have a depressed coefficient of friction (DCOF), in percentage points, related to the composite average coarseness (C), in mg/100 m, by the equation:

$$DCOF>4.27*C-44.23;$$

wherein said tissue paper has a specific tensile strength between about 9 and about 25 g/in/g/m2 and a density between about 0.05 and about 0.20 g/cc.

2. The tissue paper of claim 1 wherein said coarse fibers have an incremental surface area less than about 0.085 square millimeters.

3. The tissue paper of claim 2 wherein said cellulose fibers have a composite average fiber length between about 1 mm and about 1.5 mm.

4. The tissue paper of claim 3 wherein said cellulose fibers have a composite average coarseness between about 12 mg/100 m and about 16 mg/100 m.

5. The tissue paper of claim 3 wherein the specific tensile strength is between about 11 and about 17 g/in/g/m$^2$.

6. The tissue paper of claim 5 wherein the density is between about 0.08 and about 0.15 g/cc.

7. The tissue paper of claim 6 wherein said cellulose fibers comprise at least 10% of coarse cellulose fibers selected from the group consisting of recycled fibers, chemithermomechanical fibers and mixtures thereof.

8. The tissue paper of claim 7 wherein said tissue paper comprises a single ply, said ply comprising three superposed layers, an inner layer and two outer layers, said inner layer being located between two said outer layers, wherein said inner layer comprises cellulose fibers with a length-weighted average length of at least about 1 mm, and wherein each of two said outer layers comprises fibers with a length-weighted average length less than about 1 mm.

9. The tissue paper of claim 8 wherein said tissue paper is pattern densified such that zones of relatively high density are dispersed within a high bulk field.

10. The tissue paper of claim 7 wherein said cellulose fibers comprise from about 0.05% to about 2.0% by weight of the chemical softener.

11. The tissue paper of claim 10 wherein said cellulose fibers are chemically softened with a quaternary ammonium compound having the formula:

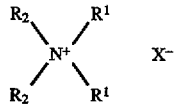

wherein each $R_2$ substituent is a C1–C6 alkyl or hydroxyalkyl group, or mixture thereof; each $R_1$ substituent is a C14–C22 hydrocarbyl group, or mixture thereof; and $X^-$ is a compatible anion.

12. The tissue paper of claim 10 wherein said cellulose fibers are chemically softened with a biodegradable quaternized amine-ester compound having the formula:

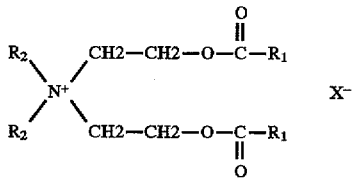

wherein each $R_1$ is a C13–C19 hydrocarbyl group or mixture thereof; $R_2$ is a C1–C6 alkyl or hydroxyalkyl group, or mixture thereof; and $X^-$ is a compatible anion.

13. The tissue paper of claim 10 wherein said cellulose fibers are chemically softened with a polysiloxane compound.

14. The tissue paper of claim 10 wherein said cellulose fibers are chemically softened with a softener selected from the group consisting of sorbitan esters, ethoxylated sorbitan esters, propoxylated sorbitan esters, mixed ethoxylated/propoxylated sorbitan esters, and mixtures thereof.

15. The tissue paper of claim 9 wherein said cellulose fibers comprise from about 0.05% to about 2.0% by weight of a chemical softener.

16. The tissue paper of claim 15 wherein said cellulose fibers are chemically softened with quaternary ammonium compound having the formula:

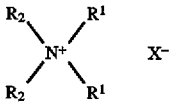

wherein each $R_2$ substituent is a C1–C6 alkyl or hydroxyalkyl group, or mixture thereof; each $R_1$ substituent is a C14–C22 hydrocarbyl group, or mixture thereof; and $X^-$ is a compatible anion.

17. The tissue paper of claim 15 wherein said cellulose fibers are chemically softened with a biodegradable quaternized amine-ester compound having the formula:

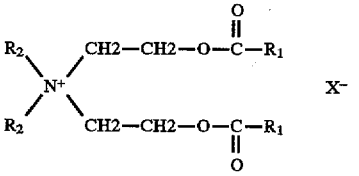

wherein each $R_1$ is a C13–C19 hydrocarbyl group or mixture thereof; $R_2$ is a C1–C6 alkyl or hydroxyalkyl group, or mixture thereof; and $X^-$ is a compatible anion.

18. The tissue paper of claim 15 wherein said cellulose fibers are chemically softened with a polysiloxane compound.

19. The tissue paper of claim 15 wherein said cellulose fibers are chemically softened with a softener selected from the group consisting of sorbitan esters, ethoxylated sorbitan esters, propoxylated sorbitan esters, mixed ethoxylated/propoxylated sorbitan esters, and mixtures thereof.

* * * * *

UNITED STATES PATENT AND TRADEMARK OFFICE

CERTIFICATE OF CORRECTION

PATENT NO. : 5,679,218
DATED : October 21, 1997
INVENTOR(S) : Kenneth Douglas Vinson, et. al.

It is certified that error appears in the above-indentified patent and that said Letters Patent is hereby corrected as shown below:

Column 9, line 41, "densifted", both occurrences, should read -- densified --.

Column 9, line 43, "densifted" should read -- densified --.

Column 9, line 45, "densifted" should read -- densified --.

Column 9, line 47, "densifted" should read -- densified --.

Column 9, line 48, "densifted" should read -- densified --.

Column 9, line 53, "denified" should read -- densified --.

Column 9, line 58, "1987," should read -- 1987; --.

Column 10, line 14, "densifted" should read -- densified --.

Column 10, line 23, "densifted" should read -- densified --.

Column 13, line 36, ".slide" should read -- slide --.

Column 19, line 42, "Ohio." should read -- Ohio --.

Column 20, line 43, "Ohio." should read--Ohio --.

Signed and Sealed this

Sixteenth Day of November, 1999

*Attest:*

Q. TODD DICKINSON

*Attesting Officer*

*Acting Commissioner of Patents and Trademarks*